US009822593B2

(12) United States Patent
Eilertsen et al.

(10) Patent No.: US 9,822,593 B2
(45) Date of Patent: Nov. 21, 2017

(54) DEVICE FOR A PIPE HANDLING UNIT AND METHOD OF INSERTING AND WITHDRAWING A PIPE STRING IN/FROM A BOREHOLE

(71) Applicant: West Drilling Products AS, Stavanger (NO)

(72) Inventors: Bjorn Eilertsen, Hundvag (NO); Odd B. Skjaerseth, Stavanger (NO)

(73) Assignee: West Drilling Products AS, Stavanger (NO)

( * ) Notice: Subject to any disclaimer, the term of this patent is extended or adjusted under 35 U.S.C. 154(b) by 631 days.

(21) Appl. No.: 14/354,470

(22) PCT Filed: Feb. 20, 2013

(86) PCT No.: PCT/NO2013/050032
§ 371 (c)(1),
(2) Date: Apr. 25, 2014

(87) PCT Pub. No.: WO2013/125961
PCT Pub. Date: Aug. 29, 2013

(65) Prior Publication Data

US 2014/0352978 A1 Dec. 4, 2014

(30) Foreign Application Priority Data

Feb. 22, 2012 (NO) ..... 20120184

(51) Int. Cl.
*E21B 19/16* (2006.01)
*E21B 19/06* (2006.01)
(Continued)

(52) U.S. Cl.
CPC ..... *E21B 19/16* (2013.01); *E21B 3/02* (2013.01); *E21B 3/06* (2013.01); *E21B 19/06* (2013.01)

(58) Field of Classification Search
CPC ..... E21B 17/021; E21B 3/02; E21B 3/045; E21B 3/06; E21B 19/06; E21B 19/16; E21B 19/161
See application file for complete search history.

(56) References Cited

U.S. PATENT DOCUMENTS 5,575,344 A 11/1996 Wireman
6,550,128 B1 4/2003 Lorenz
(Continued)

FOREIGN PATENT DOCUMENTS

EP 1980709 3/2008
NO 20090898 8/2010
(Continued)

OTHER PUBLICATIONS

International Search Report and Written Opinion for PCT/NO2013/050032, dated Jun. 18, 2013.

*Primary Examiner* — Michael Wills, III
(74) *Attorney, Agent, or Firm* — Andrus Intellectual Property Law, LLP

(57) ABSTRACT

A pipe-handling system includes at least two pipe-handling units arranged in a vertically displaceable manner along respective guide tracks of, respectively, first and second portions of a tower. The pipe-handling unit is provided with lower and upper rotary units spaced apart vertically on a chassis. Each of the rotary units is provided with a rotatable tong and a hanging-off device. A method is for inserting and withdrawing a pipe string in/from a borehole by the use of the pipe-handling system.

16 Claims, 9 Drawing Sheets

(51) Int. Cl.
*E21B 3/02* (2006.01)
*E21B 3/06* (2006.01)

(56) References Cited

U.S. PATENT DOCUMENTS

| | | | | |
|---|---|---|---|---|
| 8,408,334 | B1 * | 4/2013 | Orgeron | E21B 19/155 175/52 |
| 8,936,424 | B1 * | 1/2015 | Barnes | E21B 19/02 414/22.63 |
| 2005/0126792 | A1 | 6/2005 | Berry | |
| 2009/0057019 | A1 * | 3/2009 | LaValley | E21B 19/14 175/85 |
| 2012/0000671 | A1 * | 1/2012 | Krohn | E21B 19/14 166/380 |
| 2013/0302114 | A1 * | 11/2013 | Reddy | E21B 3/02 414/22.55 |

FOREIGN PATENT DOCUMENTS

| | | |
|---|---|---|
| NO | 20100123 | 7/2011 |
| SE | 450144 | 6/1987 |
| WO | 2010098672 | 9/2010 |
| WO | 2011049467 | 4/2011 |

* cited by examiner

DEVICE FOR A PIPE HANDLING UNIT AND METHOD OF INSERTING AND WITHDRAWING A PIPE STRING IN/FROM A BOREHOLE

CROSS-REFERENCE TO RELATED APPLICATIONS

This application is the U.S. national stage application of International Application PCT/NO2013/050032, filed Feb. 20, 2013, which international application was published on Aug. 29, 2013, as International Publication WO2013/125961 in the English language. The international application is incorporated herein by reference, in entirety. The international application claims priority to Norwegian Patent Application No. 20120184, which is incorporated herein by reference.

A pipe-handling system is described, which includes at least two pipe-handling units arranged in a vertically displaceable manner along respective guide tracks in, respectively, first and second tower columns arranged in a tower. A method of inserting and withdrawing a pipe string in/from a borehole by using the pipe-handling system is described as well.

Within the sphere of drilling technology, in particular in exploration and production drilling in oil and gas fields, great efforts are made to increase the efficiency of the processes, especially when drilling at great sea depths or when the boreholes are long-ranging ones. The development of horizontal drilling has contributed to the use of very large pipe-string lengths today. The Norwegian patent applications 20090898 and 20100123 deal with techniques that make it possible to keep a pipe string continuously moving while running in or pulling out, or while drilling. The cost reductions entailed by such continuous pipe-string running are considered to be essential for carrying out cost-effective operations in existing and new fields. NO 20090898 and NO 20100123 which have been filed in the name of the rightful owner of this patent application are incorporated herein by reference in their entirety.

The invention has for its object to remedy or reduce at least one of the drawbacks of the prior art or at least provide a useful alternative to the prior art.

The object is achieved through features which are specified in the description below and in the claims that follow.

In what follows, unless it is explicitly mentioned, the term "pipe" is used as a collective term for individual pipes, pipe sections made up of several individual pipes, and a pipe string constructed by joining several individual pipes or several pipe sections that can be screwed together.

A pipe-handling system has been provided, which includes at least two pipe-handling units arranged in a vertically displaceable manner independently of each other in a tower arranged over a structure in which a borehole is to be or has been formed. The pipe-handling system is arranged to carry out continuous insertion or withdrawal in/from the borehole of a pipe string made up of pipes which can be screwed together, of a kind known per se, wherein, for example, the pipe string may be a drill string, a casing, a production tubing or a marine riser. Each pipe-handling unit includes a chassis, on which upper and lower rotary units are arranged, each including a rotatable tong arranged for releasably holding a pipe fixed, a slips arrangement for hanging off a pipe, a pipe section or a pipe string in the pipe-handling unit, and a supporting system positioned between the rotary unit and a base arranged on the chassis. The rotatable tongs are each separately provided with a rotary drive, typically in the form of an electric motor provided with a gear transmission. The pipe-handling units are connected to respective guide tracks which extend in parallel and in the vertical direction in the tower and are spaced apart horizontally.

The vertical displacement of the pipe-handling units may be provided by a first set of driving wheels, connected to a motor, engaging a portion of the respective guide track, typically in the form of toothed wheels engaging a pitch rack which constitutes part of the guide track.

To provide the possibility of continuous drilling, the lower rotary unit is preferably connected to a continuous circulation unit for drilling fluid, for example of the kind disclosed in NO 20100123.

One rotary unit, preferably the upper one, may be vertically displaceable relative to the other rotary unit. The vertical displacement is provided by one or more linear actuators, typically in the form of one or more electric motors connected to a drive which is in engagement with one or more pitch racks on the chassis, or one or more hydraulic cylinders or winches connecting the displaceable rotary unit and the chassis.

The pipe-handling units may be arranged in respective tower columns which are spaced apart, the rotary units being arranged in such a way that they can be displaced sideways away from the centre axis of the borehole in order thereby to make it possible to let one pipe-handling unit pass the other. This lateral displacement may be provided by the rotary units being displaceable or pivotal relative to the framework of the pipe-handling unit or by the tower column being pivotal around a vertical axis.

The pipe-handling unit may be sectioned, an upper chassis section with the upper rotary unit being vertically displaceable relative to a lower chassis section with the lower rotary unit.

In one embodiment, the pipe-handling unit is also provided with a second set of driving wheels, these driving wheels being arranged to be driven independently of the first set of driving wheels. With this embodiment of the pipe-handling unit, the tower may be telescopic, the telescoping part of the tower being provided with a vertical, elongated engagement portion arranged for engagement with the second set of driving wheels, typically by the second set of driving wheels being toothed wheels engaging a second pitch rack. Thereby the pipe-handling unit may be used to extend the telescopable tower by the pipe-handling unit being locked to the guide track on the fixed part of the tower and the second set of driving wheels then being set into rotation, moving the telescopable part of the tower until it has reached a desired position in which it is locked to the fixed part of the tower with securing means suitable therefor.

The invention also includes a method of inserting and withdrawing a pipe string in/from a borehole by means of the pipe-handling systems described above.

In a first aspect, the invention relates more specifically to a pipe-handling system comprising at least two pipe-handling units arranged in a vertically displaceable manner along respective guide tracks in, respectively, first and second tower columns arranged in a tower, characterized by the pipe-handling unit being provided with lower and upper rotary units vertically spaced apart on a chassis, and each of the rotary units being provided with a rotatable tong and a hanging-off device.

One of the lower and upper rotary units may be arranged in a vertically displaceable manner along a portion of the chassis.

The displaceable rotary unit and the chassis may be interconnected by a linear actuator.

The displaceable rotary unit may be provided with a secondary drive which includes one or more secondary toothed wheels in engagement with a corresponding pitch rack arranged on a portion of the chassis.

A circulation unit may be connected to the lower rotary unit, arranged to maintain a continuous supply of drilling fluid to a pipe string connected to said rotary unit.

The lower and upper rotary units may be arranged on, respectively, lower and upper chassis sections, and the lower and upper chassis sections may be releasably connectable to each other and are provided with independent drives arranged to displace the chassis sections relative to each other in a vertical direction.

An upper drive on the chassis may include a first set of driving wheels engaging a first engagement portion connected to the guide track, and a second set of driving wheels which are arranged to be in engagement with a second engagement portion vertically arranged on a telescope tower portion which is displaceably connected to the respective first or second tower column. The driving wheels may be toothed wheels, and the engagement portions may be pitch racks.

In a second aspect, the invention relates more specifically to a method of inserting and withdrawing a pipe string in/from a borehole by the use of a pipe-handling system as described above, the pipe string being moved continuously in the axial direction of the borehole, characterized by the method including the following steps:

a) a first pipe or pipe section is hung off in a rotationally rigid manner in a lower rotary unit or an upper rotary unit of a first pipe-handling unit;
b) the first pipe-handling unit moves the first pipe/pipe section down the centre axis of the borehole;
c) a second pipe or pipe section is hung off in a lower rotary unit or an upper rotary unit of a second pipe-handling unit;
d) the second pipe-handling unit is moved downwards towards the first handling unit, bringing the second pipe/pipe section to connect to the first pipe/pipe section by the second pipe/pipe section being rotated to be screwed together with the first pipe/pipe section;
e) said rotary unit of the first pipe-handling unit is disengaged from the pipe string as the pipe string has been hung off in a rotationally rigid manner in said rotary unit of the second pipe-handling unit;
f) the first pipe-handling unit is displaced upwards after the lower and upper rotary units have been moved away from the centre axis of the borehole;
g) the steps b)-f) are repeated until the pipe string is complete; and
h) the steps a)-g) are reversed until the pipe string has been disassembled.

In a third aspect, the invention relates more specifically to a method of joining together or disassembling a pipe string by the use of a pipe-handling system including a lower pipe-handling section independently displaceable relative to an upper pipe-handling section, the pipe string being moved continuously in the axial direction of the borehole, characterized by the method including the following steps:

a) a first pipe is hung off in a rotationally rigid manner in a rotary unit of the lower pipe-handling section;
b) the lower pipe-handling section moves the first pipe down the centre axis of the borehole;
c) the upper pipe-handling section is placed in its upper position in which a second pipe is hung off in a rotary unit of the upper pipe-handling section;
d) the upper pipe-handling section is displaced downwards towards the lower pipe-handling section, bringing the second pipe to connect to the first pipe by the second pipe being rotated to be screwed together with the first pipe;
e) the rotary unit of the lower pipe-handling section is disengaged from the pipe string as the pipe string has been hung off in a rotationally rigid manner in the rotary unit of the upper pipe-handling section;
f) the upper pipe-handling section and the pipe string are moved downwards;
g) the lower pipe-handling section is moved upwards towards the upper pipe-handling section;
h) the lower pipe-handling section is moved downwards at a rate equal to the rate of the upper pipe-handling section while the rotary unit of the lower pipe-handling section is being connected to the pipe string;
i) the upper pipe-handling section is released from the pipe string;
j) the steps b)-i) are repeated until the pipe string is complete; and
k) the steps a)-j) are reversed until the pipe string has been disassembled.

The pipe/pipe section/pipe string may be hung of in a rotatable tong or in a slips arrangement in the rotary unit.

In what follows, an example of a preferred embodiment is described, which is visualized in the accompanying drawings, in which.

Figure 6A:
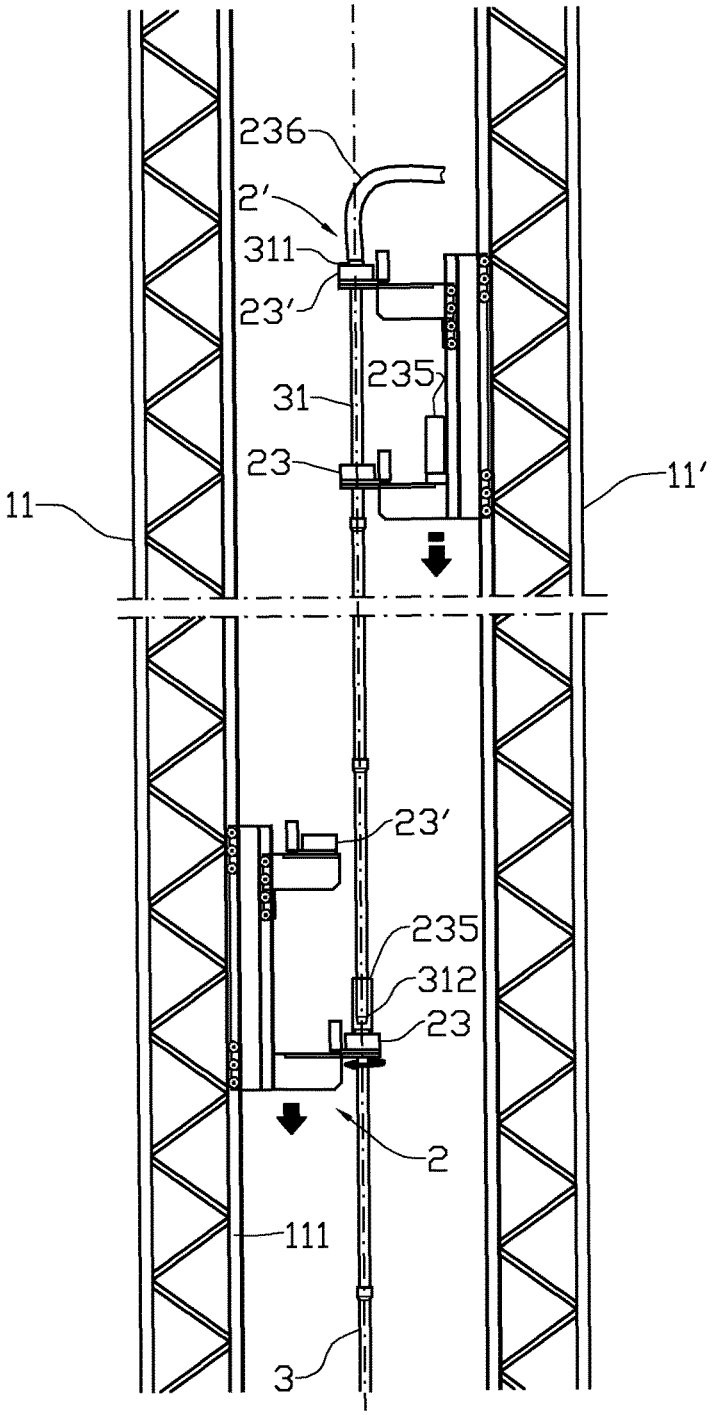
Figure 6B:
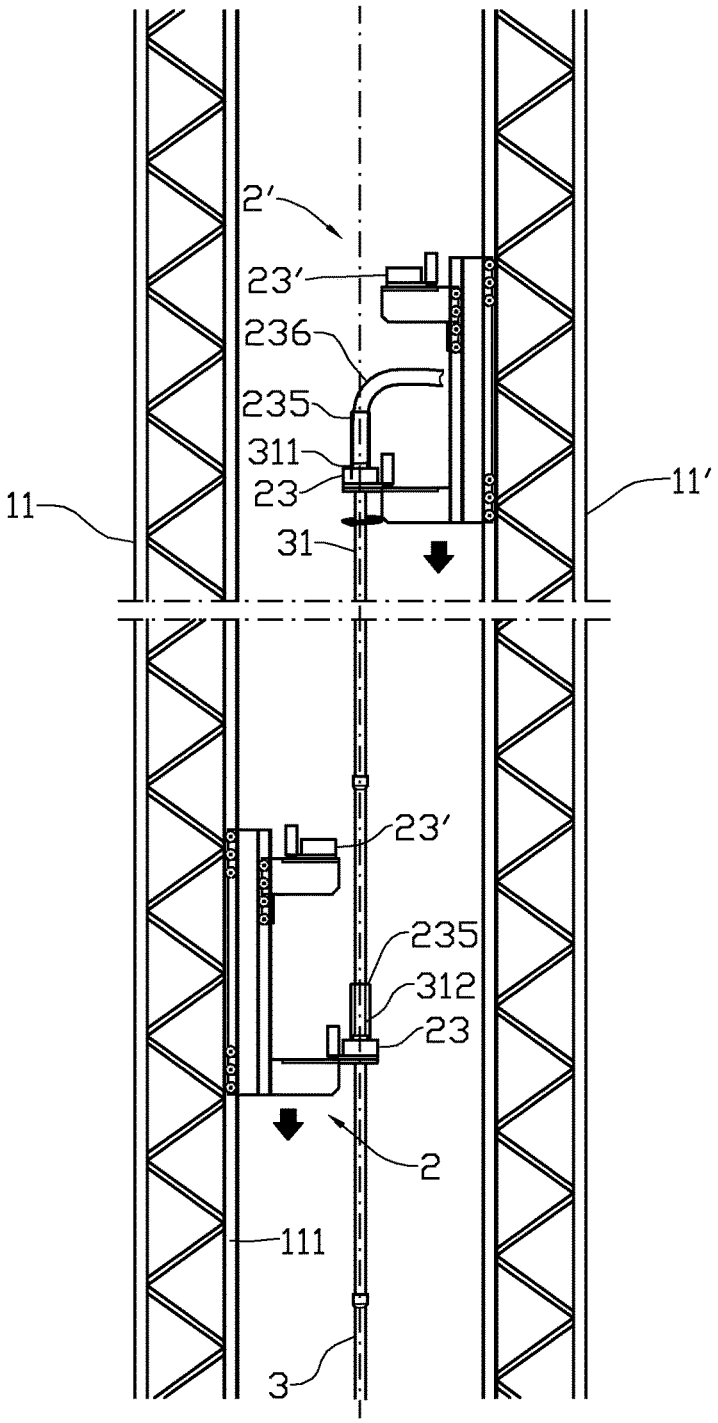
Figure 7A:
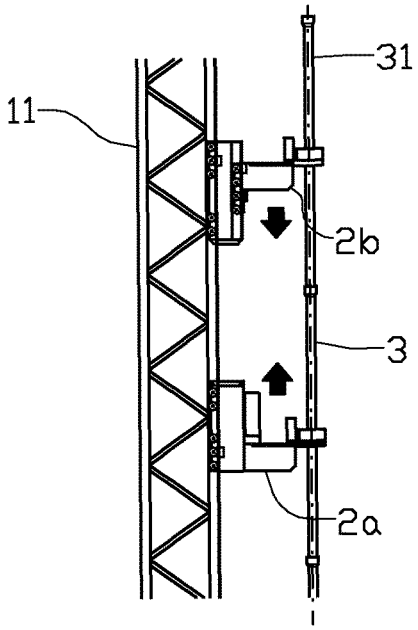
Figure 7B:
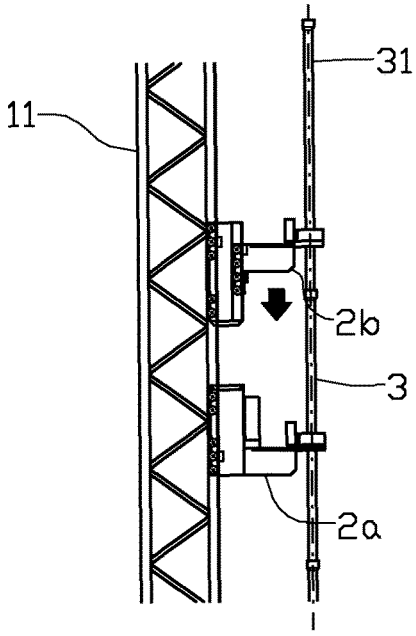
Figure 7C:
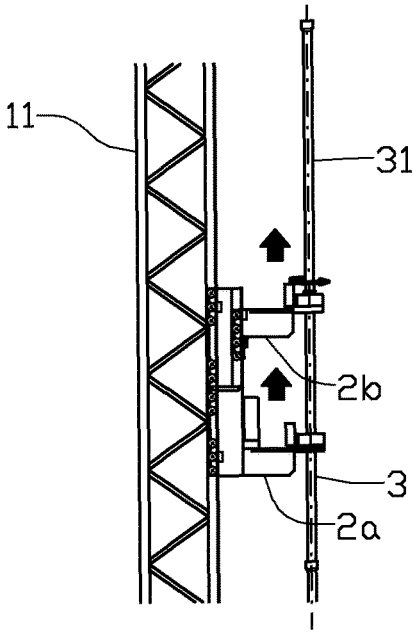
Figure 7D:
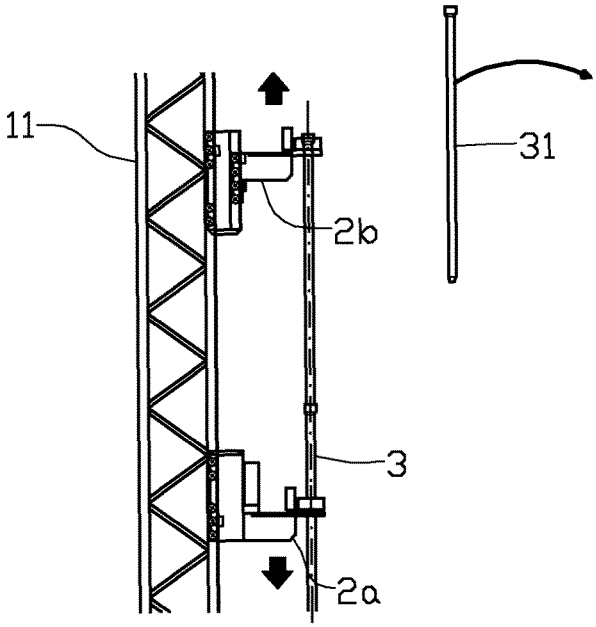
Figure 8:
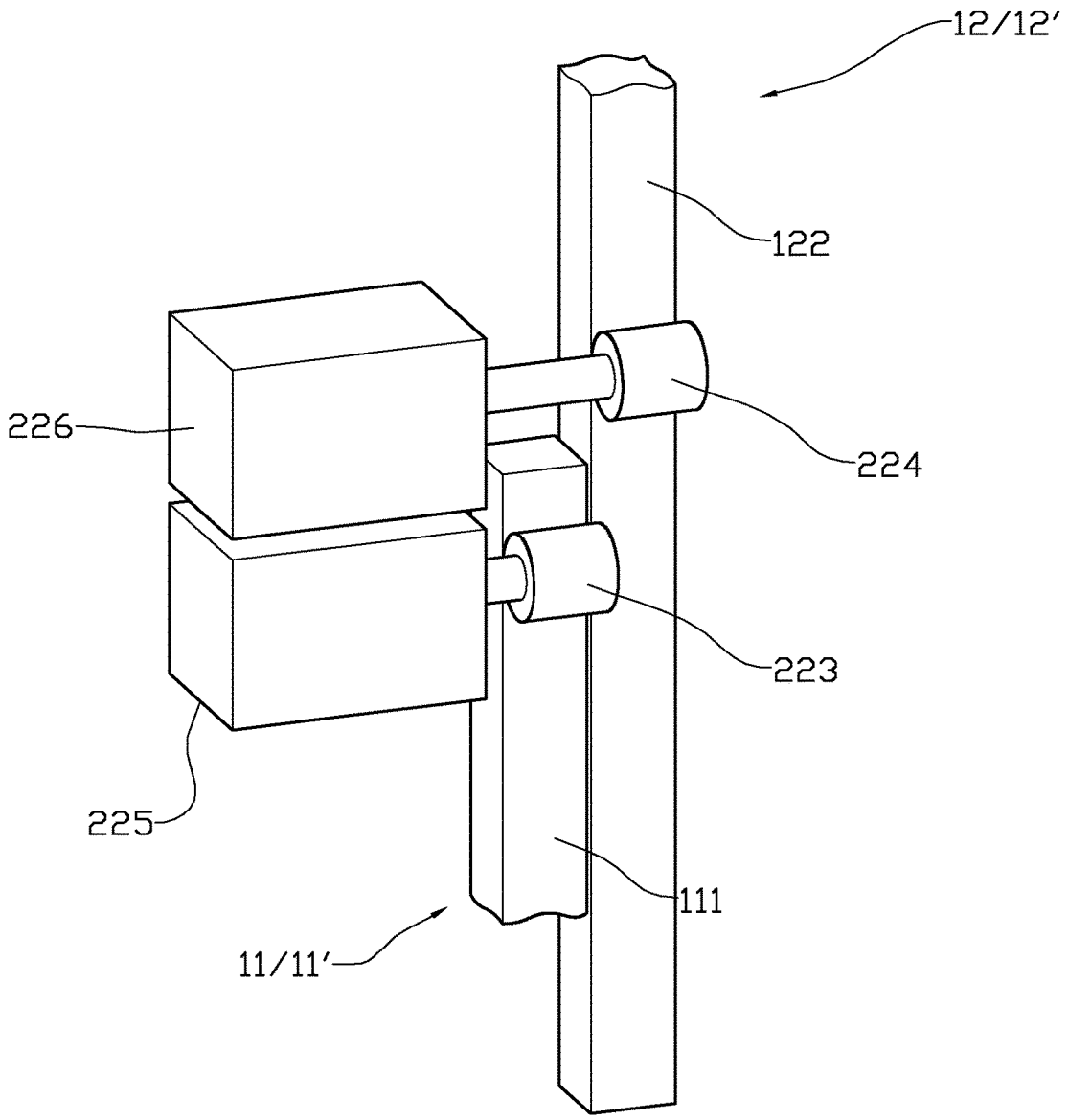

FIGS. 6*a* and 6*b* show principle drawings of two steps in the use of the pipe-handling system according to the invention during drilling with continuous drilling-mud circulation;

FIGS. 7*a*-7*d* show principle drawings of different steps in the use of a sectioned pipe-handling unit when joining a pipe to a pipe string; and FIG. 8 shows, in a section, a principle drawing of a pipe-handling unit with a second drive system arranged to move a telescopable portion of a tower.

Figure 1:
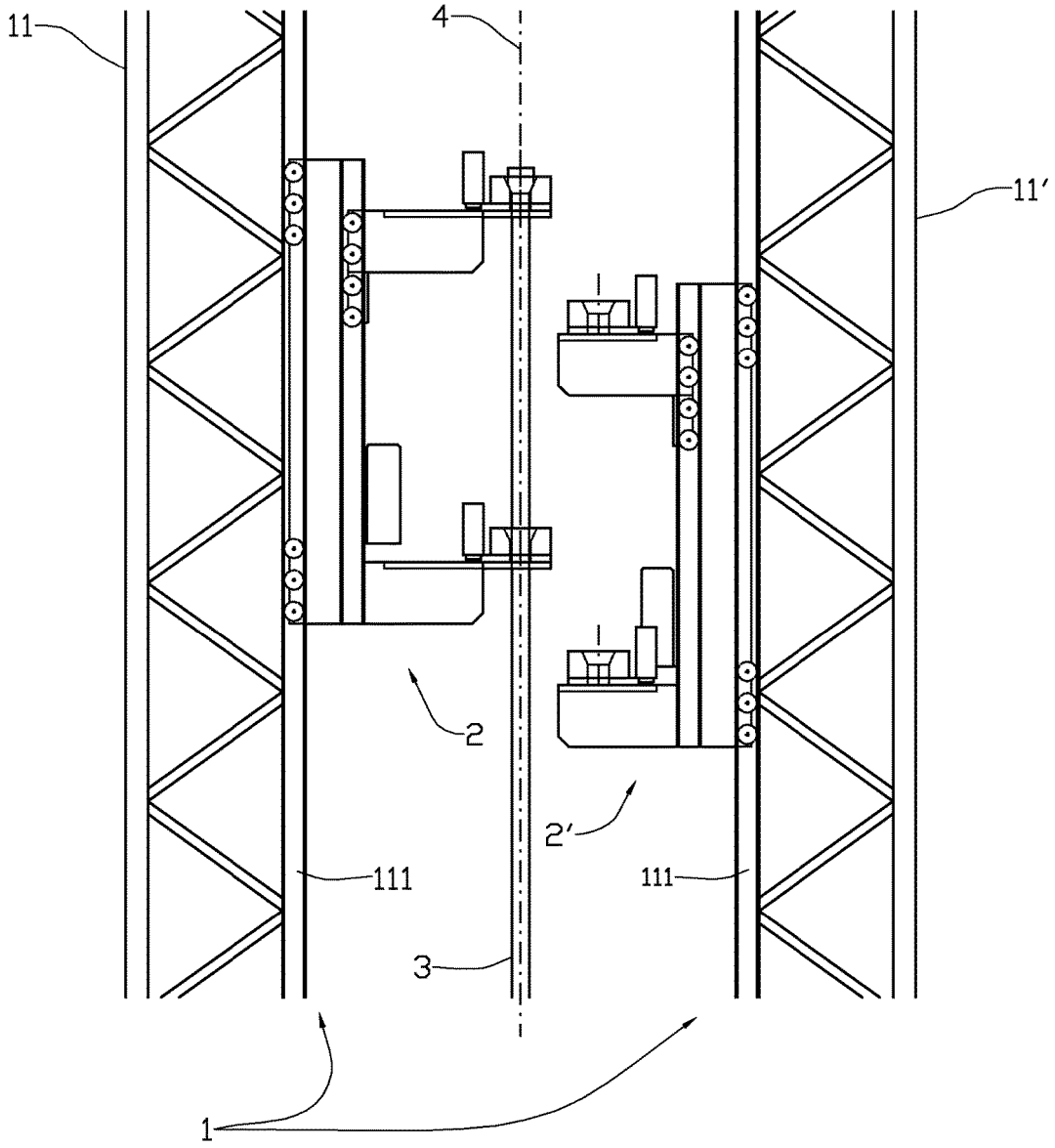
FIG. 1 shows a side view of a section of a tower which includes two pipe-handling units arranged in first and second tower columns.

Reference is first made to FIG. 1 in which a tower 1 includes two parallel, respectively first and second, tower columns 11, 11' projecting up from a base (not shown), for example a drilling floor. The tower 1 is positioned centrically relative to a drilling-centre axis 4 which coincides with the centre axis of a pipe string 3 extending down a borehole (not shown). The tower columns 11, 11' are provided with vertical guide tracks 111 arranged for the movement of first and second pipe-handling units 2, 2' arranged in a vertically displaceable manner on respective tower columns 11, 11'.

Figure 2:
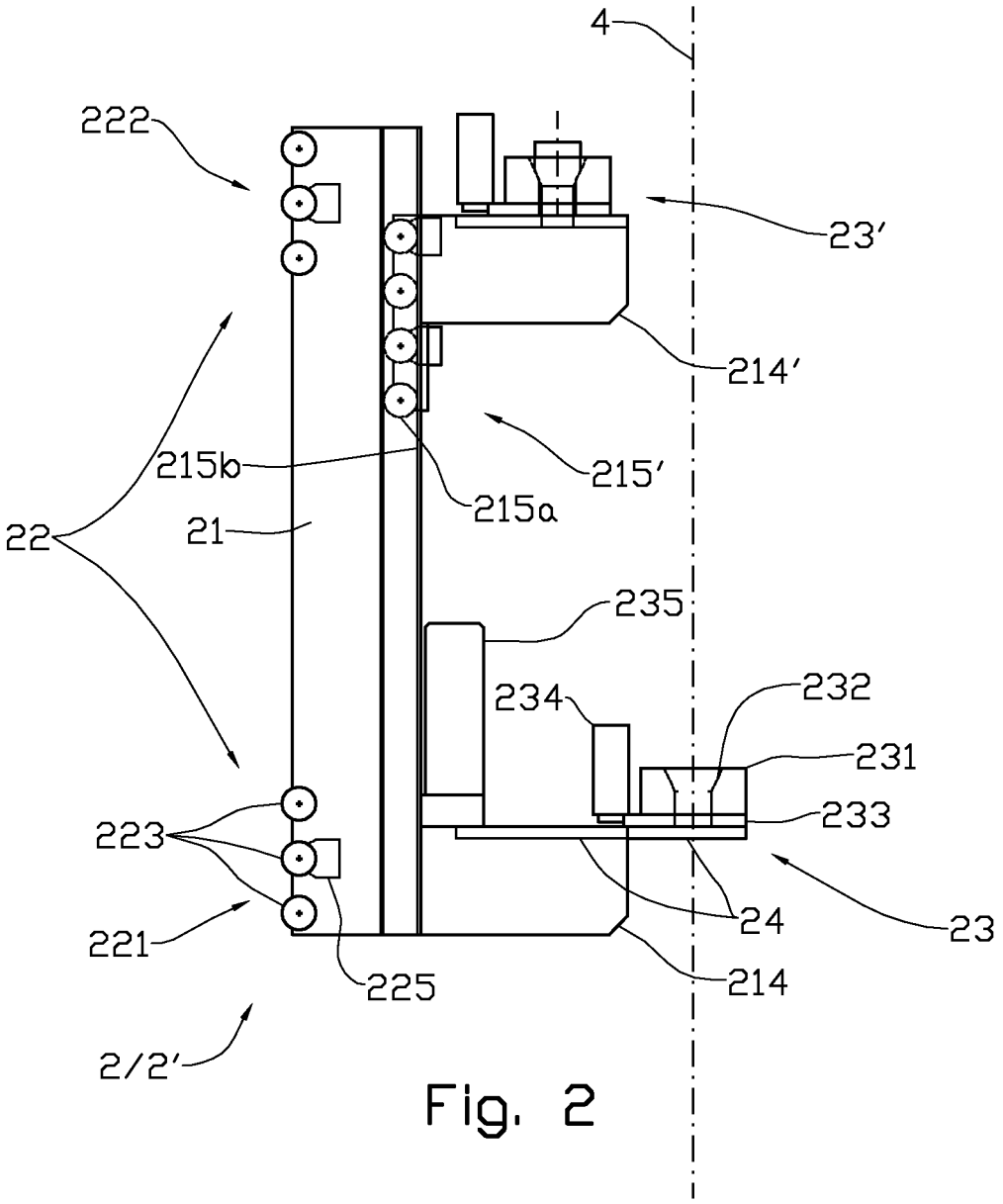
FIG. 2 shows, on a larger scale, a first embodiment of the pipe-handling unit.

Reference is now made to FIG. 2 which shows a first embodiment of the pipe-handling unit 2, 2'. A chassis 21 is provided with a propulsion system 22 including lower and upper drives 221, 222, each provided with at least one first driving motor 225 connected to a first set of driving wheels 223 which are arranged to be in engagement with the guide track 111 on the tower column 11, 11". The chassis 21 is provided with lower and upper bases 214, 214' providing support for, respectively, lower and upper rotary units 23 and 23', respectively. In the exemplary embodiment shown, the lower base 214 is fixed, whereas the upper base 214 is vertically displaceable along the chassis 21 by it being provided with a secondary drive 215', in which several secondary toothed wheels 215*a* arranged on the base 214' engage a secondary pitch rack 215*b* arranged in the vertical direction on the chassis 21.

The rotary units 23, 23', which are each arranged to engage the pipe string 3 or individual components or combined components from which the pipe string 3 has been or is to be constructed, include a rotatable tong 231 of the kind that can grip around a pipe/pipe-string portion and hold this fixed, a hanging-off device 232, typically in the form of a slips arrangement of a kind known per se, arranged to rest against a down-ward-facing shoulder portion of a pipe socket or the like, and a rotary bearing 233 which is arranged to support the tong 231 and/or the hanging-off device 232. The rotatable tong 231 is provided with a rotary drive 234. The lower rotary unit 23 is additionally provided with a circulation unit 235 for the continuous circulation of drilling fluid during a drilling operation, typically of the kind which is disclosed in NO 20100123. For the sake of exposition, the lower rotary unit 23 is shown as horizontally displaced towards the drilling-centre axis 4.

Figure 3:
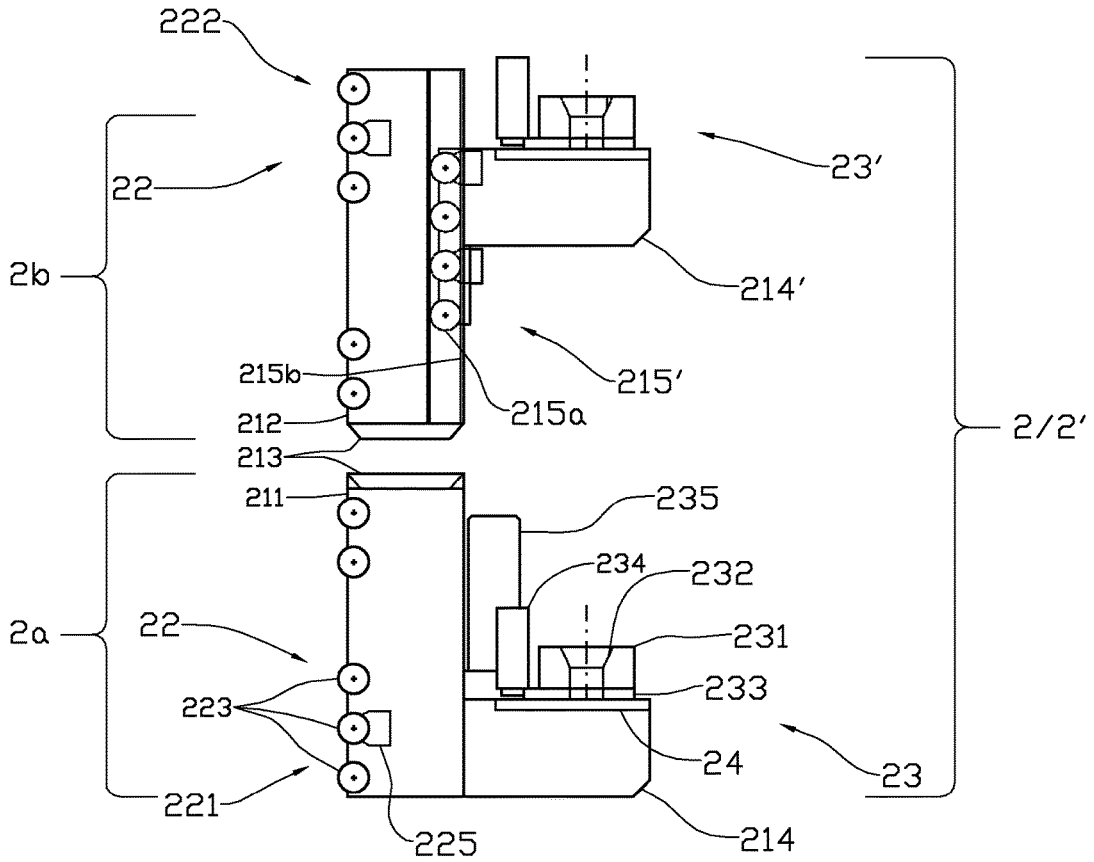
FIG. 3 shows a second embodiment of the pipe-handling unit including lower and upper pipe-handling sections.

Reference is now made to FIG. 3, in which an alternative embodiment of the pipe-handling unit 2, 2' is shown. The pipe-handling unit 2, 2' includes upper and lower pipe-handling sections 2*a* and 2*b*, respectively, the chassis 21 being dividable into lower and upper chassis sections 211 and 212, respectively. The pipe-handling sections 2*a*, 2*b* can be displaced independently of each other along the guide tracks 111 of the respective tower columns 11, 11". By means of a chassis coupling 213, the pipe-handling sections 2*a*, 2*b* can be connected and operated as an ordinary pipe-handling unit 2, 2'.

The rotary units 23, 23' in FIGS. 2 and 3 are provided with side-displacement means 24, shown schematically as horizontal slide guides here, for the rotary units 23, 23' to be displaced between an operative position at the drilling-centre axis 4 and an inoperative position with so large a clearance to the drilling-centre axis 4 that one pipe-handling unit 2 may be moved vertically without being obstructed by one of the rotary units 23, 23' of the other pipe-handling unit 2' being operative at the drilling-centre axis 4.

Figure 4:
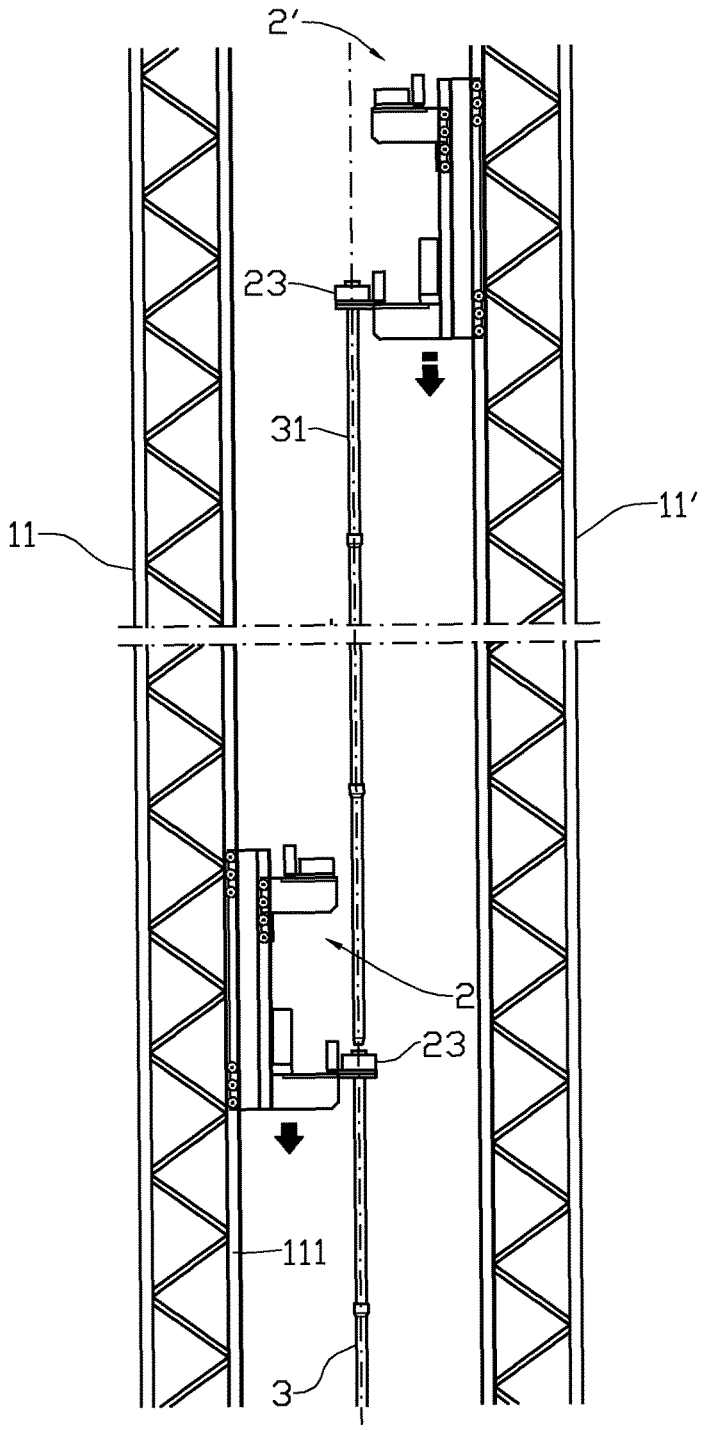
FIG. 4 shows, on a smaller scale, a principle drawing of a step in the joining of a pipe section to a pipe string by the use of the pipe-handling system according to the invention.

Reference is now made to FIG. 4, in which a pipe string is shown while being constructed by means of the pipe-handling units 2, 2' according to the invention. The pipe string 3 has been hung off and is held fixed in a rotationally rigid manner by the lower rotary unit 23 of the first pipe-handling unit 2. The pipe string 3 is moved continuously down the borehole (not shown) by the first pipe-handling unit 2 being moved down the guide track 111 of the first tower column 11. A pre-assembled pipe section 31 has been hung off and is held fixed in a rotationally rigid manner by the lower rotary unit 23 of the second pipe-handling unit 2'. The second pipe-handling unit 2' is moved downwards along the guide track 111 of the second tower column 11' at a rate greater than the rate of the pipe string 3 until contact has been achieved between the pipe string 3 and the pipe section 31, the displacement rate of the two pipe-handling units 2, 2' then being synchronized so that, by the rotation of the rotary unit 23, the pipe section 31 can be screwed together with the pipe string 3. The extended pipe string 3 is then hung off in the second pipe-handling unit 2' while the first pipe-handling unit 2 is disengaged from the pipe string 3, the rotary unit 23 is withdrawn from the drilling-centre axis 4 and the first pipe-handling unit 2 is moved upwards along the guide track 111 of the first tower column 11 to receive the next pipe section 31', as the operations described above are repeated.

Figure 5:
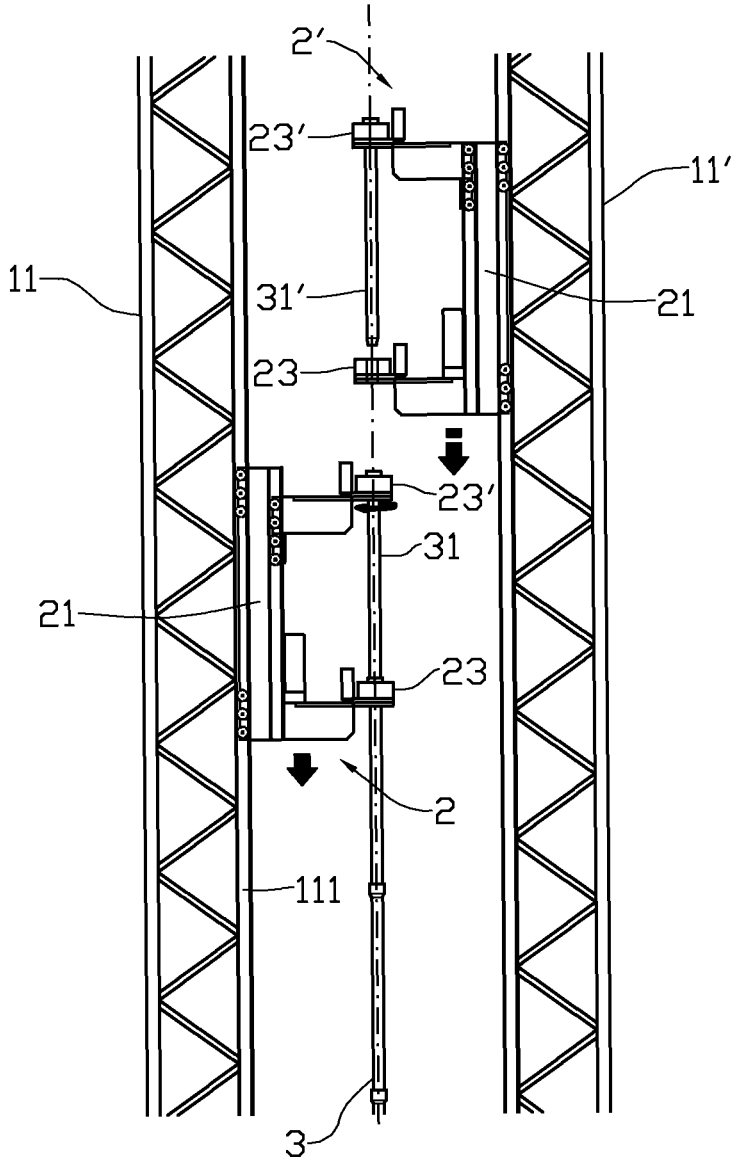
FIG. 5 shows a principle drawing of a step in the joining of a pipe to a pipe string by the use of the pipe-handling system according to the invention.

In FIG. 5, an alternative application of the pipe-handling system according to the invention is shown, the construction of a pipe string 3 by joining together individual pipes 31 being shown here, a situation typical of the construction of a casing string. Because of the building length of the pipes 31, the rotary units 23, 23' of one and the same pipe-handling unit 2, 2' may be used in a screwing operation, the lower rotary unit 23 holding the pipe string 3 fixed while the upper rotary unit 23' moves the pipe 31 vertically towards the pipe string 3, rotating the pipe 31 while screwing it together with the pipe string 3. The next pipe 31' is brought into contact with the extended pipe string 3 by being held fixed and moved vertically by the second pipe-handling unit 2'. Depending on how the second pipe 31' is placed in the second pipe-handling unit 2', the second pipe 31' may be rotated to be screwed together with the pipe string 3 by means of the lower or the upper rotary unit 23, 23'. When rotated by means of the lower rotary unit 23, a sufficient length of the second pipe 31' must project below said rotary unit 23 during the screwing-together. This will be provided by the upper rotary unit 23' being moved vertically on the chassis 21. After the pipe string 3 has been further extended by means of the second pipe 31', the extended pipe string 3 is hung off in the second pipe-handling unit 2'. The first pipe-handling unit 2 is then released from the pipe string, its rotary units 23, 23' are pulled away from the pipe string 3 and the first pipe-handling unit 2 is moved upwards along the guide track 111 of the first tower column 11 to a position in which the pipe-handling unit 2 can receive a new pipe 31. Throughout the operation, a continuous downward displacement of the one of the pipe-handling units 2, 2" in which the pipe string 3 has been hung off provides for the pipe string 3 to be moving down the borehole.

FIGS. 6*a* and 6*b* show two steps in the construction of a pipe string 3, here in the form of a drill string, with a continuous supply of fluid to the pipe string 3. In a first phase, fluid is supplied to the circulation unit 235 of the first pipe-handling unit 2 through the open top of the pipe string 3 as this is inside the circulation unit 235, as it is shown in FIG. 6*a*. In the next step, an upper end 311 of a pipe section 31, which is being moved towards the pipe string 3 by it being hung off in the second pipe-handling unit 2', is connected to a fluid-supply line 236 which is temporarily closed. A lower end 312 of the pipe section 31 is sluiced into the circulation unit 235, and the supply of fluid to the pipe string 3 via the circulation unit 235 ceases as fluid supply via the fluid-supply line 236 is opened. The pipe 31 is rotated by means of one of the rotary units 23, 23' of the second pipe-handling units 2', shown here as rotated by the lower rotary unit 23, while the pipe string 3 is held fixed by the first pipe-handling unit 2. After joining, the second pipe-handling unit 2' is displaced relative to the extended pipe string 3 so that the upper end and the fluid-supply line 236 are sluiced into the circulation unit 235 of the second pipe-handling unit 2' in order for the fluid supply to the pipe string 3 to be taken over by said circulation unit 235 as said fluid-supply line 236 is disconnected and pulled out of the circulation unit 235. The extended pipe string 3 is then hung off in the second pipe-handling unit 2', and the first pipe-handling unit 2 is released from the pipe string 3 and is moved upwards along the guide track 111 of the first tower column 11 to a position in which the pipe-handling unit 2 can receive a new pipe 31.

Throughout the operation, a continuous downward displacement of the one of the pipe-handling units 2, 2' in which the pipe string 3 has been hung off provides for the pipe string 3 to be moving down the borehole.

Reference is now made to FIGS. 7*a*-7*d*, in which the upper and lower pipe-handling sections 2*a*, 2*b* of a pipe-handling unit 2 are used for hanging off, vertically moving, holding fixed and rotating the pipe string 3 or a pipe 31 which is to be connected to or separated from the pipe string 3, shown here as disconnecting the pipe 31, which, after disconnection, is removed by means of lifting equipment (not shown) of a kind known per se. In FIGS. 7*a* and 7*b*, the upper pipe-handling section 2*b* is moved towards the lower pipe-handling section 2*a* while this is pulling the pipe string 3 upwards. In FIG. 7*c*, the upper pipe-handling section 2*b* is connected to the pipe string 3, and by means of the pipe 31 rotation relative to the pipe string 3, the pipe 31 is broken out and removed from the pipe string 3, as it is indicated in FIG. 7*d*.

In FIG. 8, a section of an exemplary embodiment is shown, in which the tower column 11, 11' is provided with a vertically displaceable telescope tower portion 12, 12'. The pipe-handling unit 2, 2' is provided with a second set of driving wheels 224 connected to one or more second driving motors 226 which can be operated independently of the ordinary driving motors 225 of the propulsion system 22. The second set of driving wheels 224, typically in the form of toothed wheels, can engage an engagement portion 122 typically formed as one or more pitch racks, arranged vertically on the telescope tower portion 12 parallel to the guide tracks 111 of the tower columns 11, 11'. When the second set of driving wheels 224 is in engagement with the engagement portion 122 of the telescope tower portion 12, 12' and the pipe-handling unit 2, 2' is fixed in the tower column 11, 11', the telescope tower portion 12 may thereby be moved vertically relative to the respective tower column 11, 11' by means of the second driving motor(s) 226. After the displacement has been carried out, the telescope tower portion 12 is locked to the respective tower column 11, 11' by means of securing means not shown.

In the above description of the exemplary embodiments, operations connected to the construction of a pipe string 3 are described. It will be obvious to a person skilled in the art to reverse these processes, possibly adjust the processes, when the pipe string 3 is to be withdrawn from the borehole and disassembled.

The invention claimed is:

1. A pipe-handling system, comprising at least two pipe-handling units arranged in a vertically displaceable manner along respective guide tracks of, respectively, first and second tower columns arranged in a tower, wherein the pipe-handling units are provided with lower and upper rotary units spaced apart vertically on a chassis, and wherein each of the lower and upper rotary units is provided with a rotatable tong and a hanging-off device located inside the rotatable tong.

2. The pipe-handling system in accordance with claim 1, wherein one of the lower and upper rotary units is arranged in a vertically displaceable manner along a portion of the chassis.

3. The pipe-handling system in accordance with claim 2, wherein the upper rotary unit and chassis are interconnected by a linear actuator.

4. The pipe-handling system in accordance with claim 2, wherein the upper rotary unit is provided with a drive which includes one or more toothed wheels in engagement with a corresponding pitch rack arranged on a portion of the chassis.

5. The pipe-handling system in accordance with claim 1, wherein, to the lower rotary unit, a circulation unit is connected, arranged to maintain a continuous supply of drilling fluid to a pipe string which is connected to said lower rotary unit.

6. The pipe-handling system in accordance with claim 1, wherein the lower and upper rotary units are arranged on, respectively, lower and upper chassis sections, and the lower and upper chassis sections are releasably connected to each other and are provided with independent drives arranged to displace the chassis sections relative to each other in a vertical direction.

7. The pipe-handling system in accordance with claim 1, wherein an upper drive on the chassis includes a first set of driving wheels which are in engagement with a first engagement portion connected to the guide track, and a second set of driving wheels which are arranged to be in engagement with a second engagement portion arranged vertically on a telescope tower portion displaceably connected to the respective first or second tower column.

8. The pipe-handling system in accordance with claim 7, wherein the driving wheels are toothed wheels, and the engagement portions are pitch racks.

9. A method of inserting and withdrawing a pipe string in or from a borehole by the use of a pipe-handling system, the pipe string being moved continuously in the axial direction of the borehole, wherein the method comprises:

a) hanging a first pipe or pipe section off in a rotationally rigid manner in a lower rotary unit or an upper rotary unit of a first pipe-handling unit, wherein each of the lower and upper rotary units of the first pipe-handling unit is provided with a rotatable tong and a slips arrangement located inside the rotatable tong;

b) wherein the first pipe-handling unit moves the first pipe or pipe section down a center axis of the borehole;

c) hanging a second pipe or pipe section off in a lower rotary unit or an upper rotary unit of a second pipe-handling unit, wherein each of the lower and upper rotary units of the second pipe-handling unit is provided with a rotatable tong and a slips arrangement located inside rotatable tong;

d) wherein the second pipe-handling unit is moved downwards towards the first handling unit, bringing the second pipe or pipe section to connect to the first pipe or pipe section by the second pipe or pipe section being rotated to be screwed together with the first pipe or pipe section;

e) disengaging said lower rotary unit or said upper rotary unit of the first pipe-handling unit from the pipe string as the pipe string has been hung off in a rotationally rigid manner in said lower rotary unit or said upper rotary unit of the second pipe-handling unit;

f) wherein the first pipe-handling unit is moved upwards after the lower and upper rotary units have been moved away from the center axis of the borehole;

g) repeating the steps b)-f) until the pipe string is complete; and h) reversing the steps a)-g) until the pipe string has been disassembled.

10. A method of joining together or disassembling a pipe string by the use of a pipe-handling system, the pipe string being moved continuously in the axial direction of the borehole, wherein the method comprises:

a) hanging a first pipe off in a rotationally rigid manner in a rotary unit of a lower pipe-handling section, wherein the rotary unit of the lower pipe-handling section is provided with a rotatable tong and a slips arrangement located inside the rotatable tong;

b) wherein the lower pipe-handling section moves the first pipe down a center axis of the borehole;

c) placing an upper pipe-handling section in an upper position in which a second pipe is hung off in a rotary unit of the upper pipe-handling section, wherein the rotary unit of the upper pipe-handling section is provided with a rotatable tong and a slips arrangement located inside the rotatable tong;

d) wherein the upper pipe-handling section is moved downwards towards the lower pipe-handling section, bringing the second pipe to connect to the first pipe by the second pipe being rotated to be screwed together with the first pipe;

e) disengaging the rotary unit of the lower pipe-handling section from the pipe string as the pipe string has been hung off in a rotationally rigid manner in the rotary unit of the upper pipe-handling section;

f) wherein the upper pipe-handling section and the pipe string are moved downwards;

g) wherein the lower pipe-handling section is moved upwards towards the upper pipe-handling section;

h) wherein the lower pipe-handling section is moved downwards at a rate equal to the rate of the upper pipe-handling section while the rotary unit of the lower pipe-handling section is being connected to the pipe string;

i) releasing the upper pipe-handling section from the pipe string;

j) repeating the steps b)-i) until the pipe string is complete; and k) reversing the steps a)-j) until the pipe string has been disassembled.

11. The method in accordance with claim 9, wherein the pipe or pipe section or pipe string is hung off in the rotatable tong or in the slips arrangement in the lower or upper rotary unit.

12. The method in accordance with claim 10, wherein the pipe or pipe section or pipe string is hung off in the rotatable tong or in the slips arrangement in the rotary unit of the lower or upper pipe-handling section.

13. A pipe-handling system, comprising at least two pipe-handling units arranged in a vertically displaceable manner along respective guide tracks of, respectively, first and second tower columns arranged in a tower, wherein the pipe-handling units are provided with lower and upper rotary units spaced apart vertically on a chassis, wherein each of the rotary units is provided with a rotatable tong and a hanging-off device, wherein one of the lower and upper rotary units is arranged in a vertically displaceable manner along a portion of the chassis, and wherein the lower rotary unit is provided with a drive which includes one or more toothed wheels in engagement with a corresponding pitch rack arranged on a portion of the chassis.

14. A pipe-handling system, comprising at least two pipe-handling units arranged in a vertically displaceable manner along respective guide tracks of, respectively, first and second tower columns arranged in a tower, wherein the pipe-handling units are provided with lower and upper rotary units spaced apart vertically on a chassis, and wherein each of the rotary units is provided with a rotatable tong and a hanging-off device, wherein, to the lower rotary unit, a circulation unit is connected, arranged to maintain a continuous supply of drilling fluid to a pipe string which is connected to said lower rotary unit.

15. A pipe-handling system, comprising at least two pipe-handling units arranged in a vertically displaceable manner along respective guide tracks of, respectively, first and second tower columns arranged in a tower, wherein the pipe-handling units are provided with lower and upper rotary units spaced apart vertically on a chassis, and wherein each of the rotary units is provided with a rotatable tong and a hanging-off device, wherein the lower and upper rotary units are arranged on, respectively, lower and upper chassis sections, and the lower and upper chassis sections are releasably connected to each other and are provided with independent drives arranged to displace the chassis sections relative to each other in a vertical direction.

16. A pipe-handling system, comprising at least two pipe-handling units arranged in a vertically displaceable manner along respective guide tracks of, respectively, first and second tower columns arranged in a tower, wherein the pipe-handling units are provided with lower and upper rotary units spaced apart vertically on a chassis, and wherein each of the rotary units is provided with a rotatable tong and a hanging-off device, wherein an upper drive on the chassis includes a first set of driving wheels which are in engagement with a first engagement portion connected to the guide track, and a second set of driving wheels which are arranged to be in engagement with a second engagement portion arranged vertically on a telescope tower portion displaceably connected to the respective first or second tower column.

* * * * *